United States Patent [19]

Bell

[11] 4,102,727

[45] Jul. 25, 1978

[54] METHOD FOR CLOSING END PORTIONS OF TUBULAR FABRIC ARTICLES

[75] Inventor: Cecil R. Bell, Pinnacle, N.C.

[73] Assignee: Hanes Corporation, Winston-Salem, N.C.

[21] Appl. No.: 779,720

[22] Filed: Mar. 21, 1977

[51] Int. Cl.[2] ..... B32B 31/18

[52] U.S. Cl. ..... 156/251; 156/267; 156/285; 156/515; 223/112

[58] Field of Search ..... 156/251, 267, 285, 382, 156/498, 515; 66/187, 202; 112/121.15; 223/112

[56] References Cited

U.S. PATENT DOCUMENTS

| | | | |
|---|---|---|---|
| 3,017,314 | 1/1962 | Kebekus et al. | 156/515 |
| 3,327,664 | 6/1967 | Bryan et al. | 223/112 |

*Primary Examiner*—Caleb Weston

*Attorney, Agent, or Firm*—Charles Y. Lackey

[57] ABSTRACT

A system for closing the open end portions of articles, particularly hosiery, includes a plurality of toe closing units arranged in a semi-circular configuration for loading by an operator. Each unit includes a camera-type shutter for gripping the garment, a heating mechanism for fusing closed the open toe, and vacuum systems urging portions of the garments on opposite sides of the shutter in opposite directions and for automatically transferring the toe waste portions and the toe closed garments to predetermined locations.

6 Claims, 8 Drawing Figures

METHOD FOR CLOSING END PORTIONS OF TUBULAR FABRIC ARTICLES

BRIEF SUMMARY AND OBJECTS OF THE INVENTION

This invention relates generally to a method ana apparatus for processing tubular fabric blanks or articles in which ends of the articles are closed, and more particularly to an automatic method and apparatus for carrying out a toe closing operation of a plurality of garments, such as stocking, panty hose, knee-high hosiery, socks, ets. of various constructions. At least a portion of the garments adjacent the open ends must be formed of thermoplastic yarns. For purposes of illustration, the invention will be described as applied to knee-high hosiery initially having open toe portions.

Briefly described, the method of the present invention involves positioning sequentially open toe hosiery articles at a plurality of toe closure stations by an operator, clamping each article, closing the toe portions by fusion, and automatically doffing the fused toe waste portions and the toe closed articles by pneumatic means.

The apparatus consists of six toe closing units mounted in a semi-circular fashion for sequential loading by one operator. Each unit includes a camera-type shutter for constricting the toe portion and a heating means for fusing the thermoplastic yarns in the toe portion. Separate vacuum sources are provided to transfer the toe closing articles and the waste material to predetermined locations.

One of the primary objects of the invention is the provision of a new and improved system for automatically closing open end portions of knit tubular articles.

Another object of the invention is the provision of a hosiery toe closing system for increasing production while reducing operator skills.

Still another object of the invention is the provision of a toe closing system which eliminates sewing and which automatically doffs the toe closed article.

Other objects and advantages of the invention will become apparent when considered in view of the following detailed description.

DETAILED DESCRIPTION OF THE INVENTION

Figure 1:
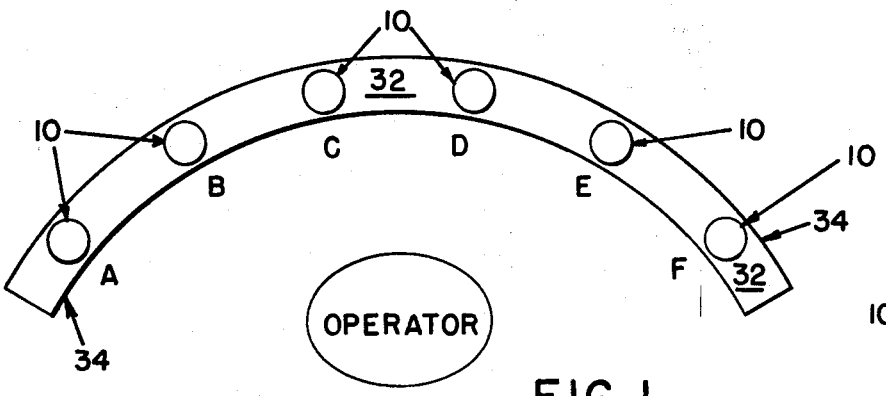
FIG. 1 is a schematic, top plan view of a plurality of toe closure stations positioned in relation to an operator.

Referring to FIG. 1, a plurality of toe closing stations A–F are arranged in a generally semi-circular fashion around an operator.

Figure 4:
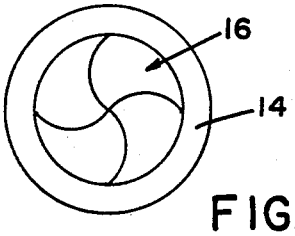
FIG. 4 is an end view of the unit of FIG. 3 illustrating the camera-type shutter for constricting a tubular article prior to closing the toe.
Figure 3:
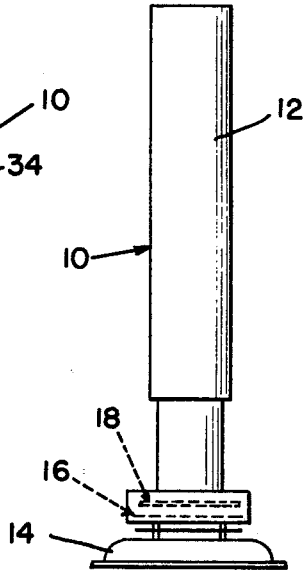
FIG. 3 is an enlarged, schematic, side elevational view of one of the toe closing units.
Figure 2:
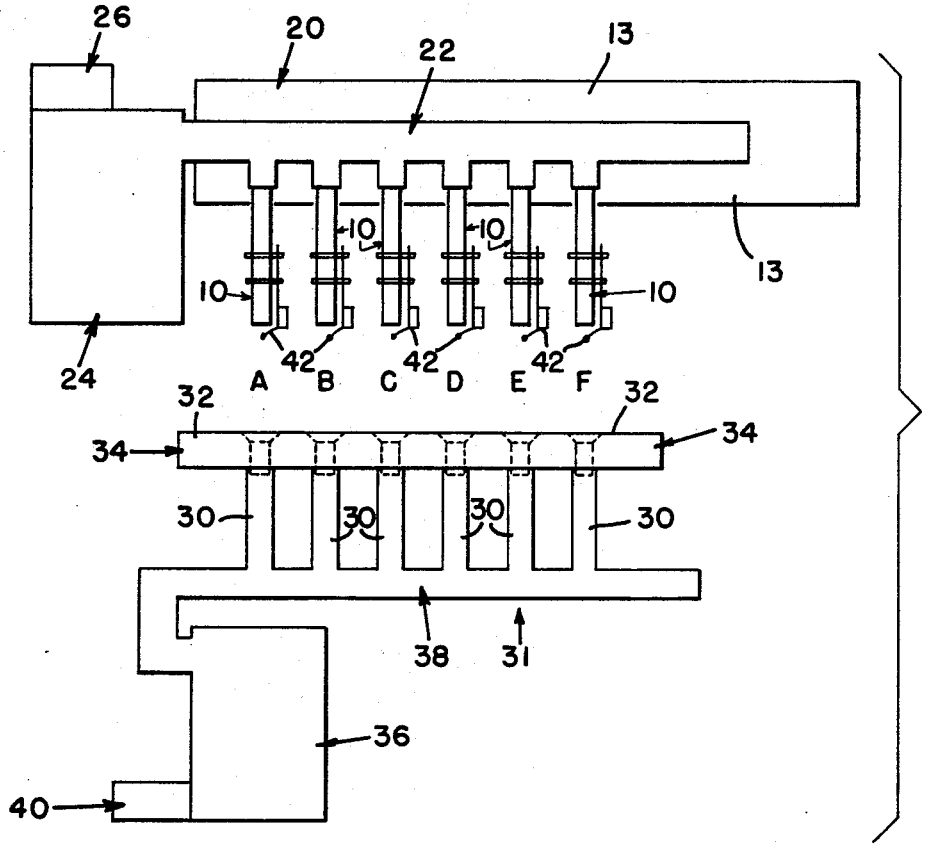
FIG. 2 is a schematic, front elevation view of the plurality of toe closure units and the pneumatic systems for removing toe portion waste and for doffing the toe closed articles.

Each of stations A–F includes a toe closing unit 10 having an elongated tubular member 12 provided with a flared, lower end 14 for receiving the open toe portion of knee-high garments. The unit 10 houses a normally open camera-type shutter 16 which is adapted to close, as shown by FIG. 4, constricting and holding the toe portion of a garment extending into tubular member 12. The unit 10 also houses a hot wire knife 18 which is adapted to move across the constricted toe portion fusing the thermoplastic yarns in the toe portion of the garment. At least a portion of the yarns must be of thermoplastic material. The toe closing units, as previously described, may be of the conventional heat seal Comfor-Toe Unit manufactured by the Billi Company of Italy. The elongated tubular members 12 are mounted in parallel, vertically disposed relation upon support 13, FIG. 2, and the open upper end of each is connected to a pneumatic system 20. In the embodiment illustrated, each unit 10 is connected to a common conduit 22 which communicates with a receptacle 24. A vacuum source 26 provides suction through the units 10 for transferring the waste toe end portions to the waste receptacle 24 after closing of garment toe portions.

Positioned below the units 10 are a like number of suction tubes 30, one located at each of stations A–F. The suction tubes 30 are substantially axially aligned with and in spaced relation to the flared ends 14 of the tubular members 12. The suction tubes 30 have flared upper ends flush with the upper surface 32 of a table or other suitable support means 34. The tubes 30, forming a part of the pneumatic system 31, have lower ends connected to a receptacle 36 by conduit 38. A power source 40 provides a vacuum through the suction tubes 30 for transferring the toe closed garments through conduit 38 and into the receptacle 36. It is to be understood that other suitable pneumatic systems may be provided for removing the waste material and for doffing the garments.

A microswitch 42 is provided at each of stations A–F for controlling the operation of shutter 16 and hot wire knife 18. In the embodiment illustrated, at each toe closing station A–F, a microswitch is supported from a unit 10 and is conveniently located for actuation by the operator when initially positioning a garment.

Figure 5:
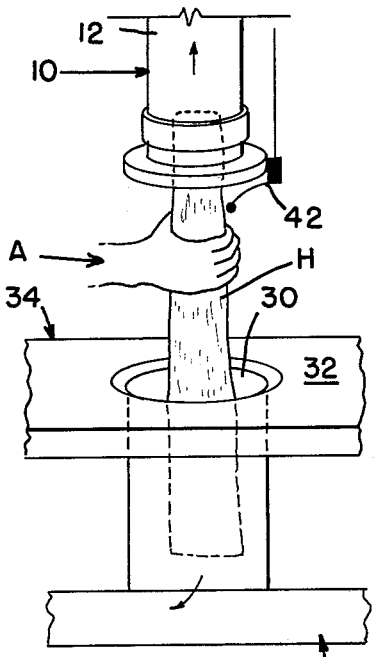
FIG. 5 is a fragmentary, schematic view of one unit illustrating the positioning of an open toe knee-high garment by an operator prior to clamping of the garment.
Figure 6:
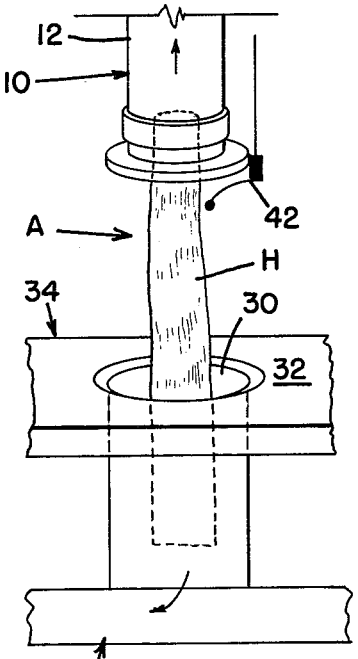
FIG. 6 is a view similar to FIG. 5 after clamping of the garment and prior to fusion of the toe portions.
Figure 7:
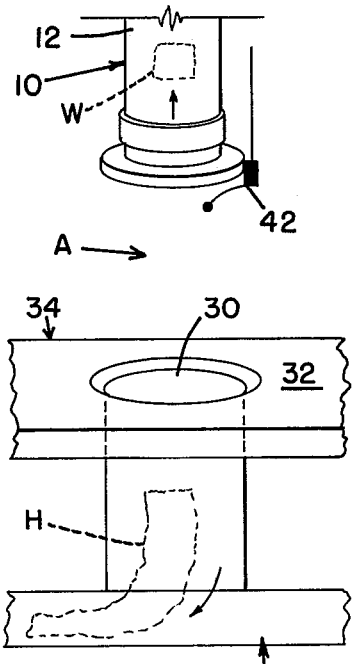
FIG. 7 is a view similar to FIGS. 5 and 6 illustrating automatic doffing of the garment after closing of the toe and automatic removal of the toe portion waste.

Referring to FIGS. 5–7, the sequence of operation for closing the open toe of a garment H at Station A will be described.

Initially, the operator picks up a knee-high garment H, holding the garment approximately 1 to 1½ inches from the open toe end and positions the garment H generally as shown at station A, FIG. 5. The operator's hand actuates microswitch 42 which closes the normally open shutter 16 by means of a solenoid, FIG. 8, in a conventional manner constricting and holding the garment H. The operator is free for other duties after closing of the shutter. The pneumatic systems 20 and 31 operate continuously such that as the operator is positioning an open toe garment for clamping by the shutter, the vacuum source 40 applies a force to the welt portion of the garment positioning the welt portion in the suction tube 30. The vacuum source 26 of pneumatic system 20 urges the toe portion of the garment above the portion gripped by the shutter 16 upwardly in tube member 12, as shown by FIG. 5. Therefore, suction is applied in opposite directions to portions of the knee-high garment located on each end of the garment portion held by the shutter 16. Approximately two seconds are required for an operator to load a garment as previously described.

Figure 8:
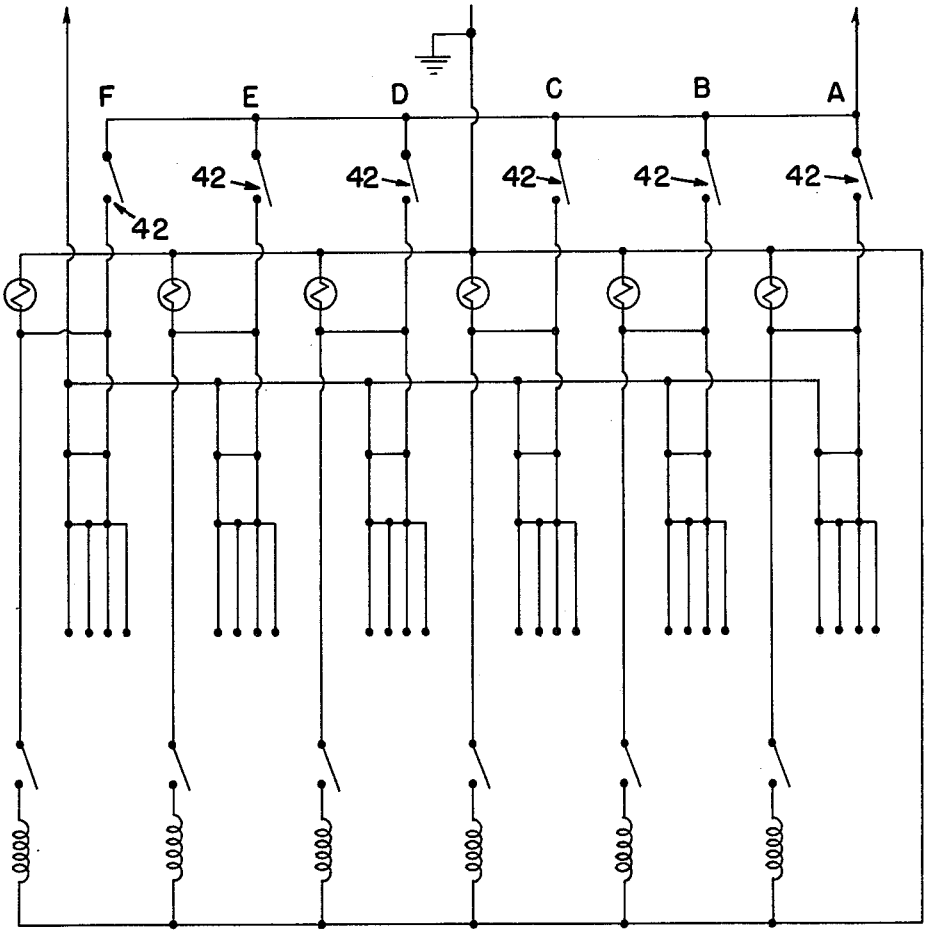
FIG. 8 is a schematic electrical diagram for the toe closing system.

Upon actuation of microswitch 42 and closing of the shutter 16, a timer, FIG. 8, is activated maintaining, in a conventional manner, the shutter in a closed position sufficiently to permit fusion of the toe portion by the heating element 18. The heating element 18 fuses the thermoplastic in the toe portion and severs the waste material W from the fused toe portion. The waste is directed by suction through conduit 22 to the waste receptacle 24.

Upon opening of the shutter 16 through the timer, the garment H having the toe portion closed by fusion is automatically doffed through suction tube 30 and displaced to receptacle 36.

Each of the units requires approximately 12 seconds for an operator to load and fuse closed a toe portion of a garment. Therefore, by adopting six units per operator, an operator can continuously feed sequentially a knee-high garment each 2 seconds to units A–F for a total capacity of approximately 75 dozen garments per hour. Current toe closing methods result in production outputs of approximately 21 dozen garments per hour. Therefore, the toe closing system of the present invention results in an impressive increase of production.

I claim:

1. The method of closing the toe portion of a tubular fabric hosiery article formed at least partially of thermoplastic yarn and provided with a welt portion and a toe portion having an open end, comprising the steps of; picking up the article and holding a first segment of the hosiery article adjacent the toe portion, transferring the article to a toe-closing station in a selected manner, applying a continuous pneumatic force to the toe portion open end of the article for urging the toe portion open end away from the remainder of the article being held at the toe closing station, applying a gripping force to a second segment of the article spaced from the first segment and intermediate the first segment and the open end of the toe portion by circumferentially gathering and constricting the tubular hosiery article, releasing the first segment of the article, applying heat to the article intermediate the gripped segment and the open end of the toe portion to fuse the thermoplastic yarns together to close the toe portion and sever the toe end waste fabric therefrom, and automatically transferring the toe closed article to a predetermined location upon release of the gripping force.

2. The method as recited in claim 1, wherein the continuous pneumatic force automatically transfers the waste toe portion to a predetermined location, remote to the toe closed article.

3. The method as recited in claim 1 further including the step of applying a continuous pneumatic force to the welt portion of the hosiery article for urging the welt portion away from the gripped article.

4. The method as recited in claim 3, wherein the continuous pneumatic forces are suction forces applied simultaneously in opposite directions to opposite ends of the tubular article.

5. The method of closing the toe portion of a tubular fabric hosiery article as recited in claim 3, wherein the tubular hosiery article in the toe closing station is retained in the generally vertically disposed relation by the gripping force and the continuous pneumatic forces, the continuous pneumatic force applied to the toe portion urging the toe portion vertically upwardly and the continuous pneumatic force applied to the welt portion urging the welt portion vertically downwardly.

6. The method of closing the toe portion of a fabric hosiery article formed at least partially of thermoplastic yarns and including a welt portion and a toe portion having an open end comprising; picking up the article and holding a first portion of the hosiery article, transferring the article to a toe-closing station, applying a first pneumatic force to the hosiery article toe portion for urging the toe portion vertically in a first direction away from the first portion of the article, applying a second pneumatic force to the welt portion for urging the welt portion vertically in a second direction away from the first portion and substantially opposite to the first direction, applying a gripping force to the hosiery article intermediate the first article portion and the article open end, releasing the first article portion, closing the article toe portion by fusing at least a portion of the thermoplastic yarns intermediate the open end and the gripping force, and automatically transferring the toe closed article to a predetermined location by the second pneumatic force upon release of the gripping force.

* * * * *